United States Patent [19]

Bussing, Jr.

[11] Patent Number: 4,692,749

[45] Date of Patent: Sep. 8, 1987

[54] WEARABLE ALARM

[76] Inventor: Wilfred C. Bussing, Jr., 2905 Bayard Park Dr., Evansville, Ind. 47714

[21] Appl. No.: 770,597

[22] Filed: Aug. 29, 1985

[51] Int. Cl.[4] ..... G08B 13/00

[52] U.S. Cl. ..... 340/574; 340/693

[58] Field of Search ..... 340/574, 540, 693, 668, 340/573; 128/903; 455/100; 200/DIG. 2, 43.11, 43.16

[56] References Cited

U.S. PATENT DOCUMENTS

| | | | |
|---|---|---|---|
| 4,158,197 | 6/1979 | Takagaki | 340/574 |
| 4,392,126 | 7/1983 | Loyola | 340/668 X |
| 4,430,757 | 2/1984 | Szakvary | 455/100 |

*Primary Examiner*—Glen R. Swann, III
*Assistant Examiner*—Thomas J. Mullen, Jr.
*Attorney, Agent, or Firm*—Warren D. Flackbert

[57] ABSTRACT

A wearable alarm, which can be in the form of a religious cross, jewelry or decorative article or the like, normally found on the user's person, which, through simple sliding action, achieves completion of a contained electrical circuitry and the energization of an audible signaling device. Entry to the operative components may be achieved in any manner, depending on the article in which the alarm is presented and, additionally, the audible alarm varied to provide a warning at any preselected distance from the wearer.

4 Claims, 7 Drawing Figures

WEARABLE ALARM

As is known, individual or personal safety during normal living activities or habits is becoming of significant concern, particularly for women, children, the elderly and those who are physically incapacitated. A number of alarm or warning devices are currently available for individual usage, as, for example, various forms of whistles, or even more protective items, such as mace. A primary need, however, is the availability of an alarm which is unobtrusive in appearance and yet readily reached for use, i.e. does not involve movement which would be readily recognized by the would-be assailant.

The invention serves importance in presenting a wearable alarm, i.e. one hanging from or attached to the person of the user, in the form of a religious cross, jewelry, such as a brooch, or the like. Briefly, the instant wearable alarm, by ready pulling movement, actuates an audible signal of any desired intensity, where the latter hopefully serves to deter or frighten the would-be assailant.

Restated otherwise, the wearable alarm herein is normally at a non-signaling condition, but, with pulling action, moves to a signaling condition, where the preceding can be accomplished by the user in an unnoticed and/or a relatively unobtrusive manner. In that the form of the wearable alarm is meaningful, ornamental and/or decorative per se, the further purpose thereof is really not known to other than the user.

In any event, a better understanding of the present invention will become more apparent from the following description, taken in conjunction with the accompanying drawing, wherein FIG. 1 is a top plan view of a wearable alarm in accordance with the teachings of the present invention, with the cover removed and the alarm at an inoperative or non-signaling condition;

FIG. 3 is a perspective view of the cover for the particular form of alarm described herein;

Figure 2:
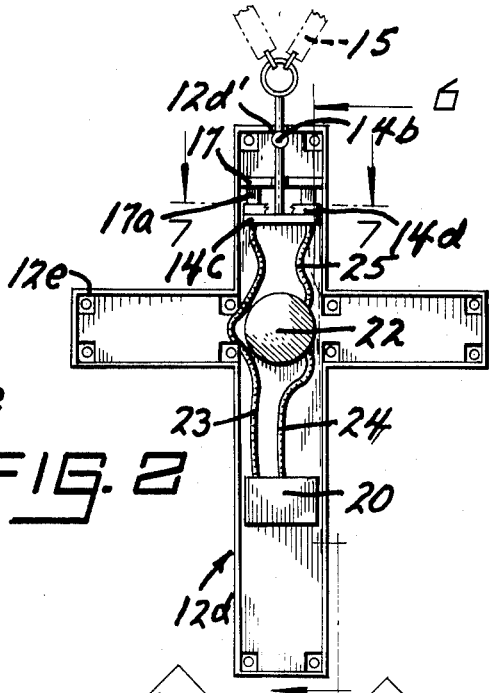
FIG. 2 is another top plan view of the instant wearable alarm, comparing to that of FIG. 1, but showing the movement thereof to an operable or audible signaling condition.
Figure 7:
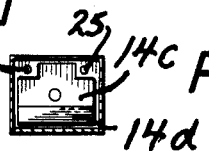
Figure 6:
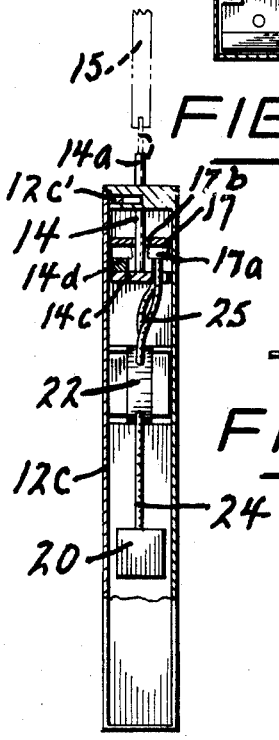

FIG. 6 is a view in side elevation, taken at line 6—6 on FIG. 2 and looking in the direction of the arrows (but with the cover in place), further detailing the operative components in an audible signaling condition; and, FIG. 7 is a view in horizontal section, taken at line 7—7 on FIG. 2 and looking in the direction of the arrows, still further detailing component configuration to achieve audible signaling.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
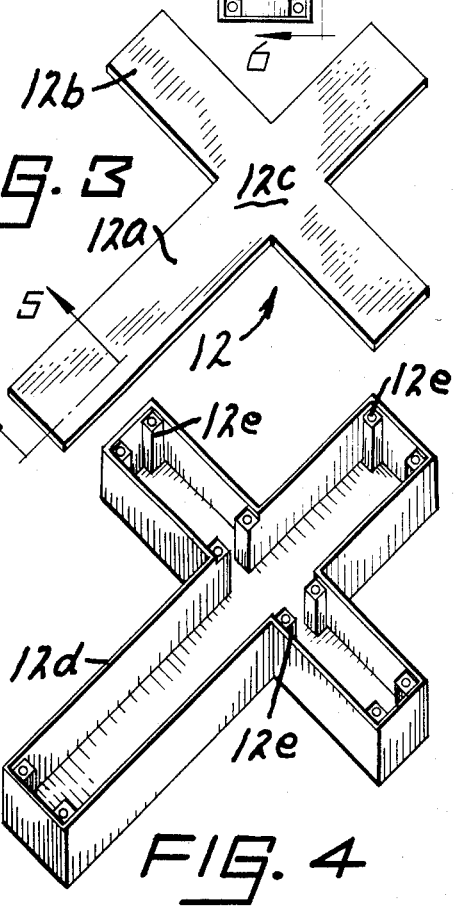
FIG. 4 is another perspective view, comparing to that of FIG. 3, but showing the housing in which the alarm components are positioned.
Figure 5:
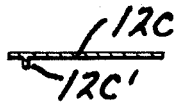
FIG. 5 is a view in vertical section, taken at line 5—5 on FIG. 3 and looking in the direction of the arrows, detailing representative cover securement.

Referring now to the figures, and particularly to FIGS. 3 and 4, the wearable alarm of the invention is typically presented in the form of a religious cross 12 including a spine 12*a* and laterally extending arms 12*b*. In the illustrated arrangement, the cross 12 is characterized by a removable cover 12*c* overlying a housing 12*d* which serves as a receiving cavity for the alarm system. In order to assemble the cover 12*c* to the housing 12*d*, the undersurface of the cover 12*c* includes downward projections 12*c'* (see FIG. 5) selectively received in correspondingly positioned sleeves 12*e* within the cavity of the housing 12*d*.

Figure 1:
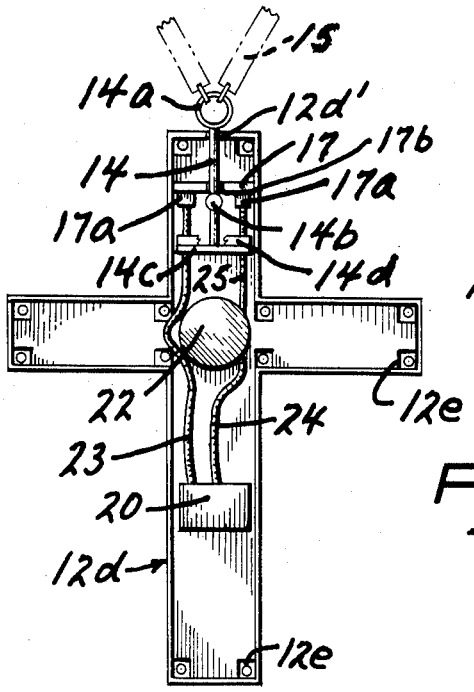

FIGS. 1, 2 and 6 compare to the showing of FIG. 4, but include the alarm system components. In this connection, the housing 12*d* includes an opening 12*d'* at the top end thereof for receiving a stem 14 with a looped end 14*a* which forms part of a necklace 15 (shown in phantom). The stem 14 includes a bulbous portion 14*b* and, at its lower end, a plate 14*c* having an electrical contact 14*d* disposed along a portion of its upper surface (see FIGS. 6 and 7). In any event, the stem 14, the bulbous portion 14*b*, the plate 14*c* and the electrical contact 14*d* are integrally arranged.

As further apparent in FIGS. 1, 2 and 6, the housing 12*d*, at the upper end of spine 12*a*, includes a fixed plate 17 supporting, on its undersurface, electrical contacts 17*a*. The fixed plate 17 is provided with a centrally disposed opening 17*b* through which stem 14 passes, i.e. the opening 17*b* is of sufficient size to permit movement of the bulbous portion 14*b* on stem 14 to selectively pass therethrough.

In order to present an operational audible device, electrical circuitry is provided which includes a power source 20, such as a battery, an audible signaling device 22, such as an emitter which may present a shrill sound, the electrical contact 14*d*, the electrical contacts 17*a*, and interconnecting power lines 23, 24 and 25 (where lines 23 and 25 extend through cut-outs in plate 14*c*—see FIG. 7).

As evident in FIGS. 1 and 2, and when the wearable alarm is actuated to emit a distress signal, the cross 12 is pulled downwardly from the position of FIG. 1 to that of FIG. 2, i.e. along the stem 14 and, as a result, the electrical contacts 17*a* on the undersurface of the fixed plate 17 are caused to engage the electrical contact 14*d* on the upper surface of the plate 14*c* supported by the stem 14. The bulbous portion 14*b* on stem 14 passes through the opening 17*b* in the fixed plate 17 and, ultimately, bears against the undersurface of the top of the cavity presented by the housing 12*d*.

When electrical contact is completed, the audible signaling device 22 is caused to operate (through the power source 20), achieving any desired form of signaling deemed to attract attention to the user. Thereafter, the cross 12 may be readily returned, by sliding action along stem 14, to the presignaling condition (FIG. 1).

As evident, therefore, from the preceding, the wearable alarm offered by the invention presents an arrangement readily and effectively operable by the user, i.e. through simple downward movement of the cross 12 to achieve completion of the electrical circuitry for initiating desired signaling. In that the alarm is wearable, and decorative, the appearance of such does not betray its important functional purpose, i.e. to the casual observer it is only a religious, fraternal and/or jewelry article customarily in use.

The wearable alarm described hereabove is susceptible to various changes within the spirit of the invention including, by way of example, and as stated, the employment of other than the illustrated cross for containing the alarm system, i.e. any decorative jewelry item, such as a brooch, could be equally effective for adaptation; the precise manner for completing the electrical circuitry may be altered, as long as sliding action effects audible signal operation; the manner of gaining access to the electrical circuitry, as for power source replacement, can be modified; and, the like. Thus, the preceding should be considered illustrative and not as limiting the scope of the following claims:

I claim:

1. A wearable alarm comprising a first portion positioned on the person of a user, a second portion slidable on said first portion, where said first portion includes first electrical contact means, and where said second portion includes second electrical contact means slectively engaging said first electrical contact means, and signaling means on said second portion responsive to said selective engagement of said second electrical contact means with said first electrical contact means, where said first portion and said second portion are disposed within a housing, where said second portion slides on a stem on said first portion, where said stem includes a bulbous portion, and where said bulbous portion engages a portion of said housing when said second electrical contact means selectively engages said first electrical contact means.

2. The wearable alarm of claim 1 where said bulbous portion on said stem abuts said second electrical contact means prior to said selective engaging of the latter with said first electrical contact means.

3. The wearable alarm of claim 1 where said first portion and said second portion are components of an ornamental article.

4. The wearable alarm of claim 3 where said ornamental article is a religious cross.

* * * * *